US008696394B1

(12) United States Patent
Langenfeld et al.

(10) Patent No.: US 8,696,394 B1
(45) Date of Patent: Apr. 15, 2014

(54) MARINE PROPULSION SYSTEMS AND COOLING SYSTEMS FOR MARINE PROPULSION SYSTEMS

(75) Inventors: Gregg D. Langenfeld, Fond du Lac, WI (US); Ryan G. Bonde, Kiel, WI (US); Scott G. Ahlswede, Plymouth, WI (US)

(73) Assignee: Brunswick Corporation, Lake Forest, IL (US)

( * ) Notice: Subject to any disclaimer, the term of this patent is extended or adjusted under 35 U.S.C. 154(b) by 356 days.

(21) Appl. No.: 13/192,271

(22) Filed: Jul. 27, 2011

(51) Int. Cl.

| | |
|---|---|
| ***B63H 20/28*** | (2006.01) |
| ***B63H 21/38*** | (2006.01) |
| ***F01M 5/00*** | (2006.01) |
| ***F01P 3/02*** | (2006.01) |
| ***F01P 3/20*** | (2006.01) |
| ***F01P 7/16*** | (2006.01) |
| ***F01P 11/08*** | (2006.01) |
| ***F16N 39/02*** | (2006.01) |

(52) U.S. Cl.
USPC ..... 440/88 C; 440/88 L; 440/88 HE; 123/41.33; 123/196 AB; 184/104.3

(58) Field of Classification Search
USPC ..... 440/88 L, 88 C–88 M, 88 HE; 123/41.33, 123/196 AB; 184/104.2, 104.3
See application file for complete search history.

(56) References Cited

U.S. PATENT DOCUMENTS

| | | | | |
|---|---|---|---|---|
| 3,380,443 | A * | 4/1968 | Tado et al. | 123/196 AB |
| 3,493,081 | A * | 2/1970 | Tado | 184/104.3 |
| 4,150,655 | A * | 4/1979 | Gaggiano et al. | 123/196 AB |
| 4,397,269 | A | 8/1983 | Hatz | |
| 4,735,590 | A * | 4/1988 | Mondek | 440/88 L |
| 5,439,404 | A * | 8/1995 | Sumigawa | 440/88 L |
| 5,921,829 | A * | 7/1999 | Iwata | 440/88 R |
| 6,349,680 | B1 | 2/2002 | Wolter et al. | |
| 6,416,372 | B1 * | 7/2002 | Nozue | 440/88 R |
| 6,869,324 | B2 * | 3/2005 | Matsuda | 440/88 C |
| 6,988,919 | B2 * | 1/2006 | Tanaka et al. | 440/88 HE |

FOREIGN PATENT DOCUMENTS

| | | | |
|---|---|---|---|
| EP | 0 787 929 B1 | 4/2001 | |
| EP | 0 785 379 B1 | 11/2001 | |
| JP | 11173131 A * | 6/1999 | F01M 5/00 |

OTHER PUBLICATIONS

Suzuki Outboard Motor, DF150/DF175 Four Stroke Service Manual, Marine & Power Products Division, #99500-96700-01E, Copyright Suzuki Motor Corporation 2005, 5 pgs.

* cited by examiner

*Primary Examiner* — Ajay Vasudeva
(74) *Attorney, Agent, or Firm* — Andrus Intellectual Property Law, LLP

(57) ABSTRACT

A marine propulsion system comprises an internal combustion engine, a cooling circuit carrying cooling fluid that cools the internal combustion engine, a sump holding oil that drains from the internal combustion engine, and a heat exchanger receiving the cooling fluid. The oil that drains from the internal combustion engine to the sump passes through and is cooled by the heat exchanger.

21 Claims, 9 Drawing Sheets

MARINE PROPULSION SYSTEMS AND COOLING SYSTEMS FOR MARINE PROPULSION SYSTEMS

FIELD

The present disclosure relates to marine propulsion systems and cooling systems for marine propulsion systems.

BACKGROUND

U.S. patent application Ser. No. 12/944,454, filed Nov. 11, 2010, the disclosure of which is hereby incorporated herein by reference in entirety, discloses systems and methods for cooling marine engines. In one example, a cooling system comprises an elongated exhaust conduit comprising a first end receiving hot exhaust gas from the marine engine and a second end discharging the exhaust gas. An elongated cooling water jacket extends adjacent to the exhaust conduit. The cooling water jacket receives raw cooling water at a location proximate to the second end of the exhaust conduit, conveys the raw cooling water adjacent to the exhaust conduit to thereby cool the exhaust conduit and warm the cooling water, and thereafter discharges the cooling water to cool the marine engine.

SUMMARY

The present disclosure results from the present inventors' research and development of marine propulsion systems and cooling systems for marine propulsion systems. In particular, the present disclosure results from research and development of cooling systems for outboard marine engines.

In one example, a marine propulsion system comprises an internal combustion engine, a cooling circuit carrying cooling fluid that cools the internal combustion engine, a sump holding oil that drains from the internal combustion engine, and a heat exchanger receiving the cooling fluid. The oil that drains from the internal combustion engine to the sump passes through and is cooled by the heat exchanger.

In another example, a marine propulsion system comprises an internal combustion engine, a cooling circuit carrying cooling fluid that cools the internal combustion engine, a sump holding oil that drains from the internal combustion engine, a heat exchanger receiving the cooling fluid, and a thermostat controlling discharge of cooling fluid from the cooling circuit to the heat exchanger. The heat exchanger receives the cooling fluid after it has cooled the internal combustion engine and the oil that drains from the internal combustion engine to the sump passes through and is cooled by the heat exchanger.

In yet another example, an outboard motor comprises an internal combustion engine, a cooling circuit carrying cooling fluid that cools the internal combustion engine, a sump holding oil that drains from the internal combustion engine, and a heat exchanger receiving the cooling fluid, wherein the oil that drains from the internal combustion engine to the sump passes through and is cooled by the heat exchanger.

BRIEF DESCRIPTION OF THE DRAWINGS

FIG. 3 is a sectional view laterally through the heat exchanger showing flow of cooling fluid there through.

DETAILED DESCRIPTION

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
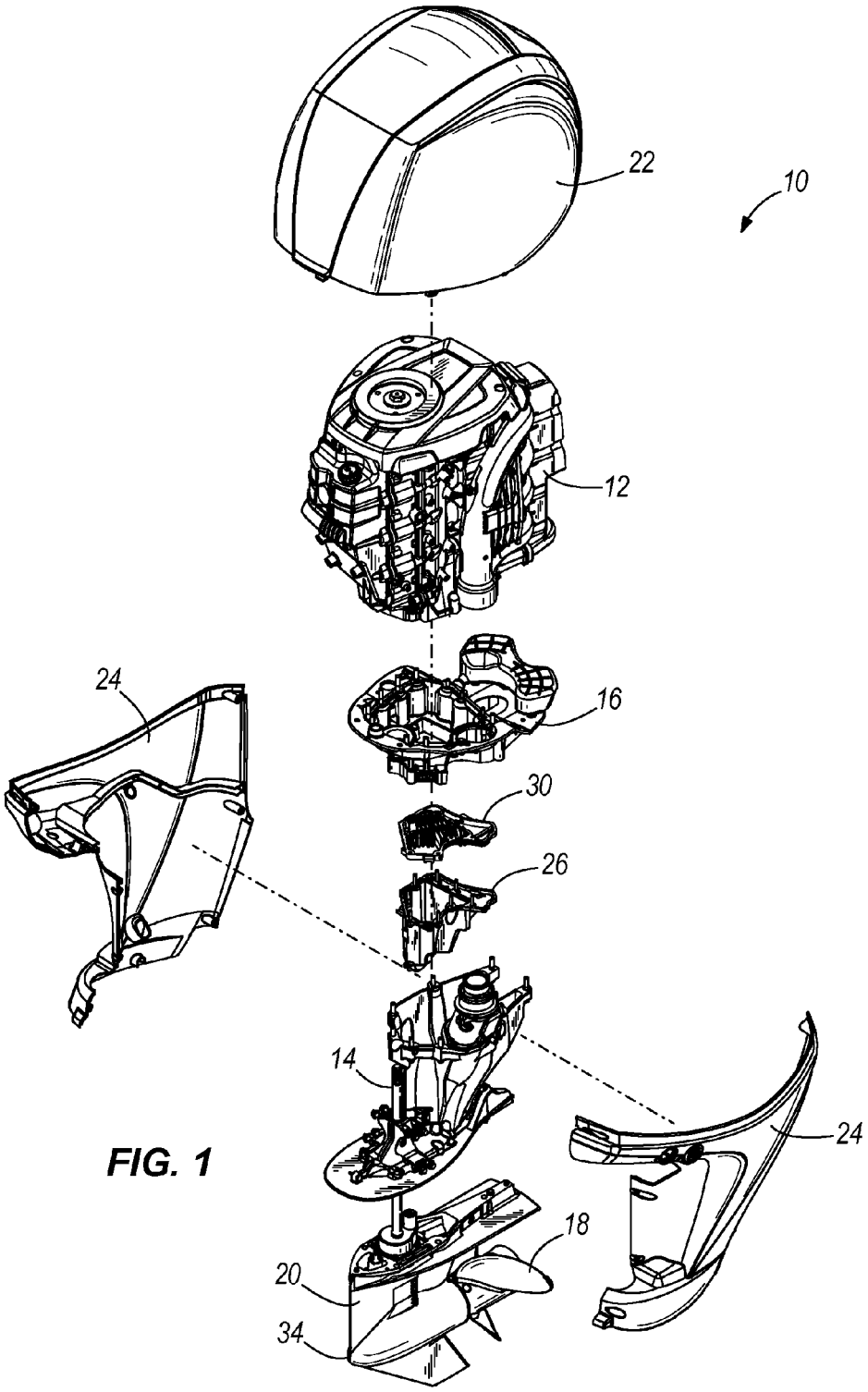
FIG. 1 is an exploded view of an outboard motor.

FIG. 1 depicts a marine propulsion system 10 that includes an internal combustion engine 12, a drive mechanism 14 and an adapter plate 16 connecting the internal combustion engine 12 to the drive mechanism 14. The drive mechanism 14 drives a propeller 18 into rotation according to conventional arrangement by gears contained in a gear housing 20. A cowling 22 covers the internal combustion engine 12 and a driveshaft housing 24 covers the drive mechanism 14. An oil sump 26 holds oil that drains from the internal combustion engine 12.

Figure 2:
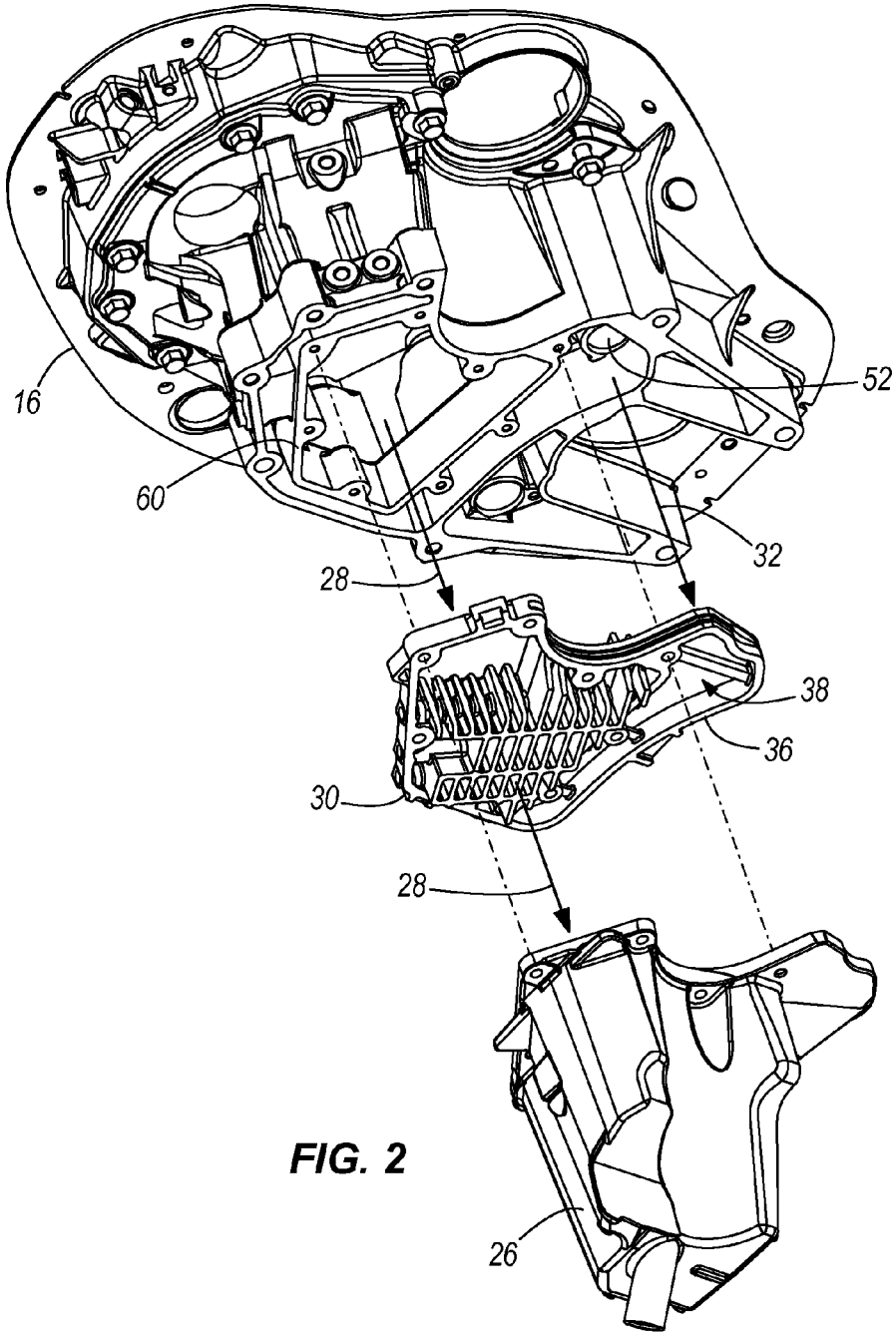
FIG. 2 is an exploded view of components of the outboard motor including an adapter plate, a heat exchanger and an oil sump.
Figure 3:
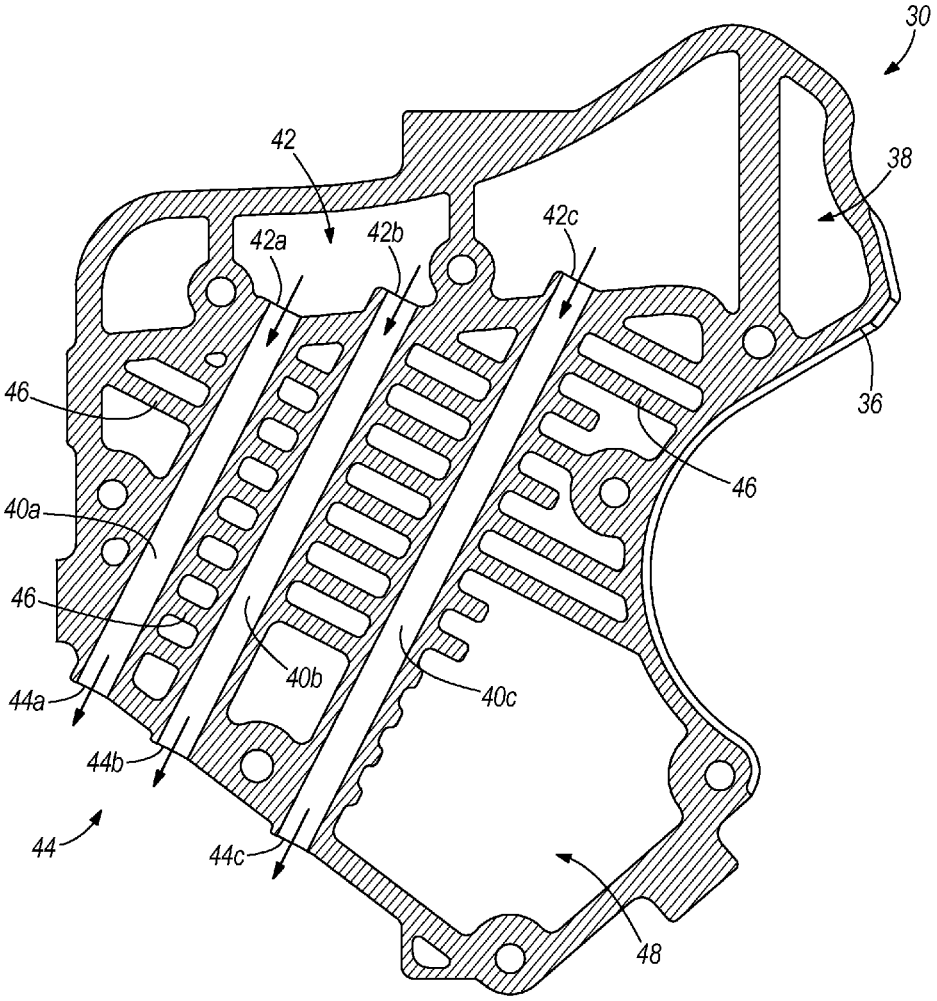
Figure 4:
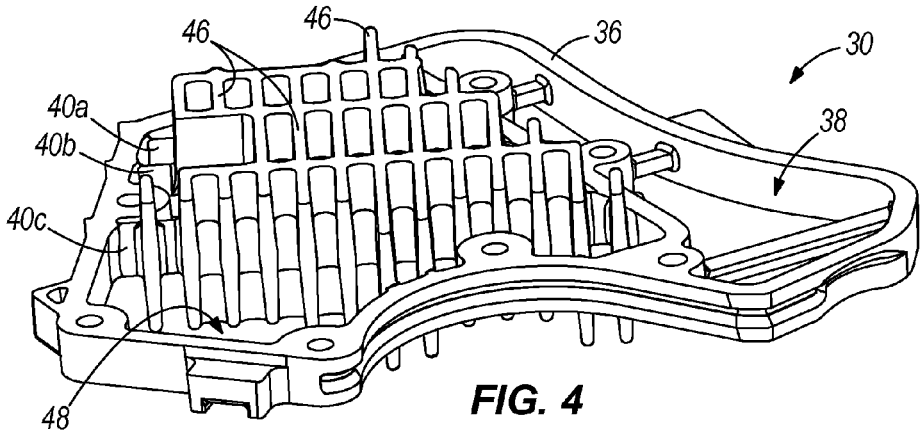
FIG. 4 is a perspective view of the heat exchanger.
Figure 5:
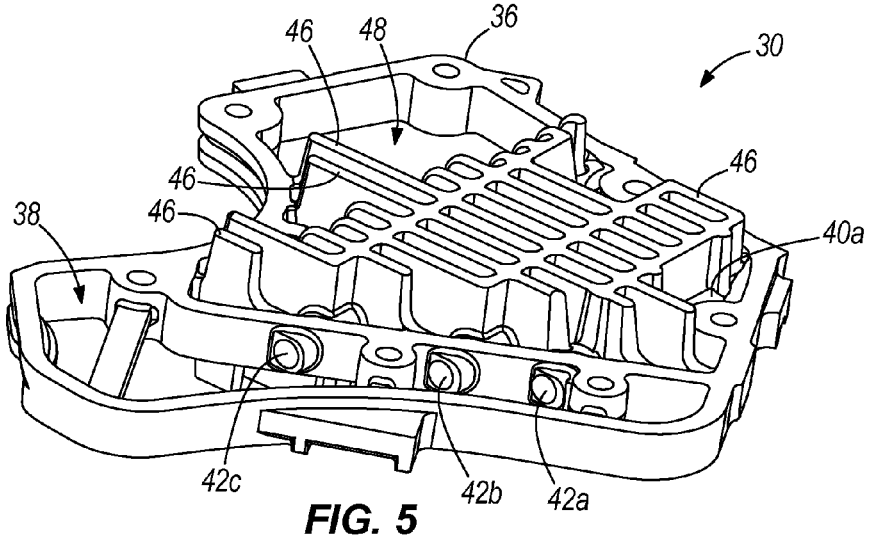
FIG. 5 is another perspective view of the heat exchanger.
Figure 6:
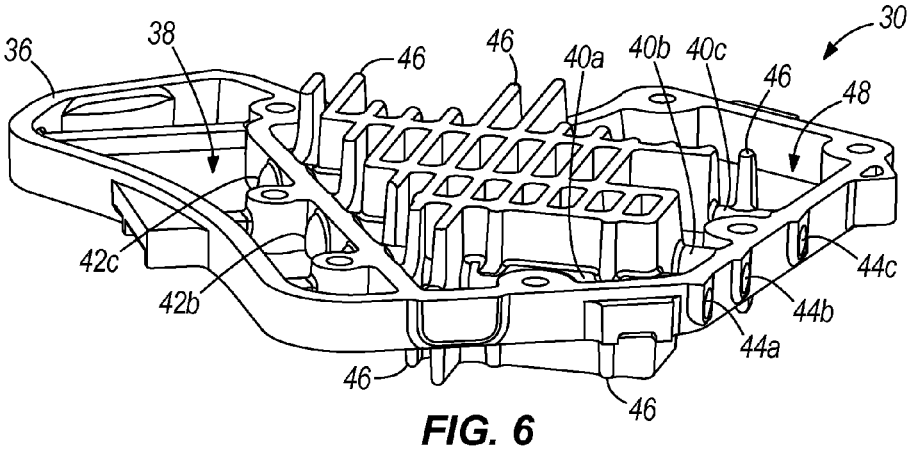
FIG. 6 is another perspective view of the heat exchanger.

Referring to FIG. 2, oil that drains from the internal combustion engine at arrow 28 passes through and is cooled by a heat exchanger 30. The heat exchanger 30 is disposed adjacent to, or in the oil sump 26 and is disposed between the adapter plate 16 connected to the internal combustion engine 12 and the oil in the oil sump 26. The heat exchanger 30 receives and is cooled by cooling fluid via the adapter plate 16 at arrow 32. In this example, the heat exchanger 30 receives the cooling fluid after it has cooled the internal combustion engine 12. As explained further below, the cooling fluid can comprise sea water drawn through an intake 34 in the gear housing 20 (see FIG. 1).

As shown in FIGS. 3-6, the heat exchanger 30 includes a frame 36 defining a plenum 38 for receiving cooling water at arrow 32 in FIG. 2. Cooling water collects in the plenum 38 and is distributed to a plurality of horizontally oriented passages, which in the example shown includes three passages 40*a*, 40*b*, 40*c*. The passages 40*a*, 40*b*, 40*c* receive cooling water at a plurality of inlets 42 which in the example shown includes three inlets 42*a*, 42*b*, 42*c* and discharge cooling water at outlets 44 which in the example shown includes three outlets 44*a*, 44*b*, 44*c*. The number of passages, inlets and outlets can vary from that shown. A plurality of fins 46 (not all of which are numbered in the drawings) extend from the plurality of passages 40*a*, 40*b*, 40*c* and are cooled by the cooling fluid flowing through the passages. In the example shown, the fins 46 are vertically oriented and constructed such that oil draining vertically from the internal combustion engine 12 flows parallel to the fins 46 and thus contacts an entire circumferential area of each of the fins 46. Increasing the flow of oil across the heat exchanger 30 increases cooling of the oil by the heat exchanger 30. The frame 36 also defines an opening 48 through which an oil pickup tube associated with the sump 26 extends.

Figure 7:
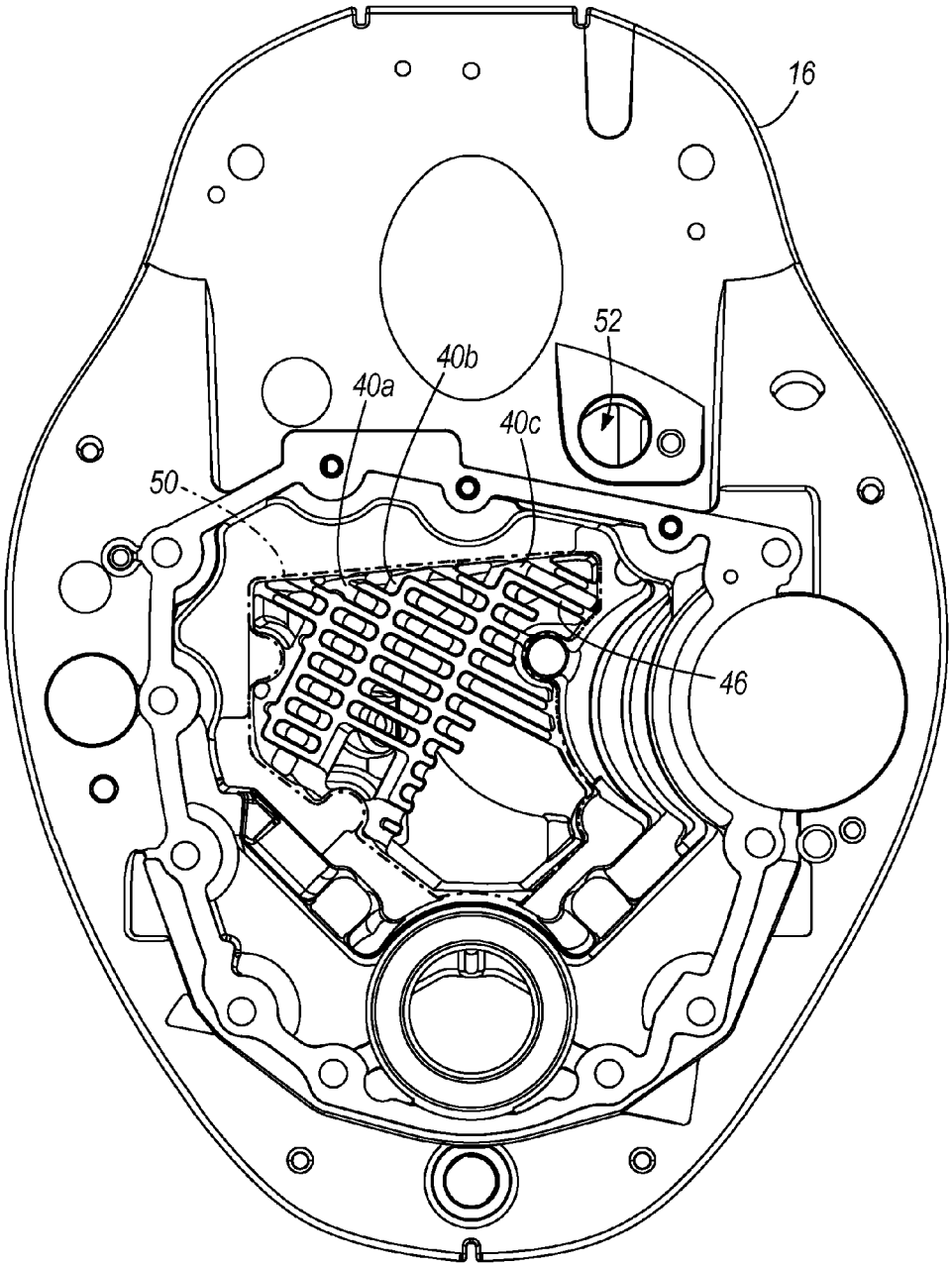
FIG. 7 is a view looking down at the top of the adapter plate and portions of the heat exchanger exposed to oil drainage from the engine.

FIG. 7 depicts the top of the adapter plate 16, which defines an opening 50 through which oil drains at arrow 28 shown in FIG. 2 to the sump 26. FIG. 7 also depicts the portions of the heat exchanger 30 that are exposed to the oil as it drains to the sump 26. These portions include the outside of passages 40*a*, 40*b*, 40*c* and the vertically extending fins 46. FIG. 7 also depicts an opening 52 through which cooling fluid is discharged to the plenum 38 of the heat exchanger 30. Opening 52 receives the cooling fluid from a thermostat associated with the system 10, as will be discussed further herein below.

Figure 8:
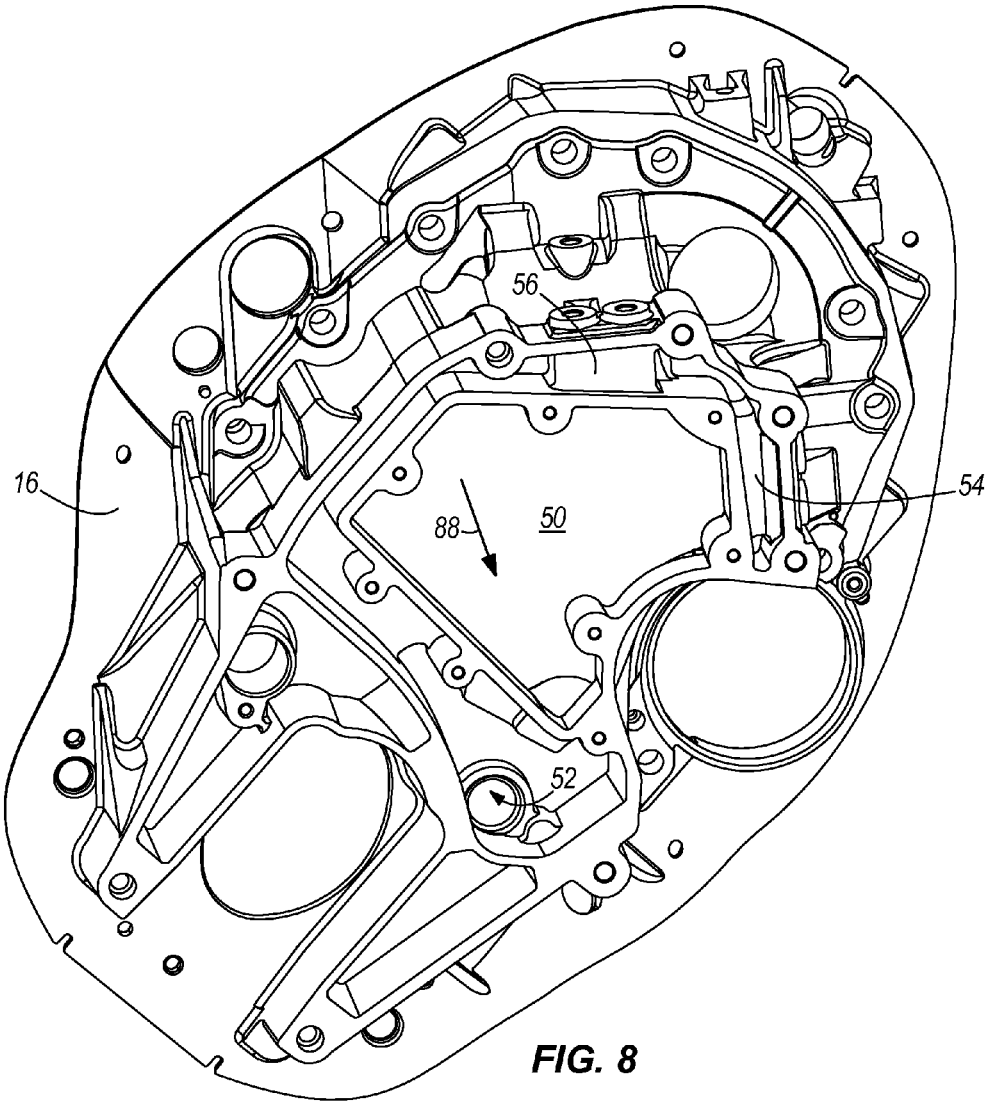
FIG. 8 is a view looking up at the bottom of the adapter plate.

FIG. 8 depicts the bottom of the adapter plate 16, showing the opening 50 for oil drainage and the opening 52 for flow of cooling fluid to the plenum 38. Additional channels 54, 56 are provided in the adapter plate 16 for bypass flow of cooling fluid around the heat exchanger 30 to a cooling jacket 58 (see FIG. 11) along the outside of sump 26, as will be described herein below.

Figure 9:
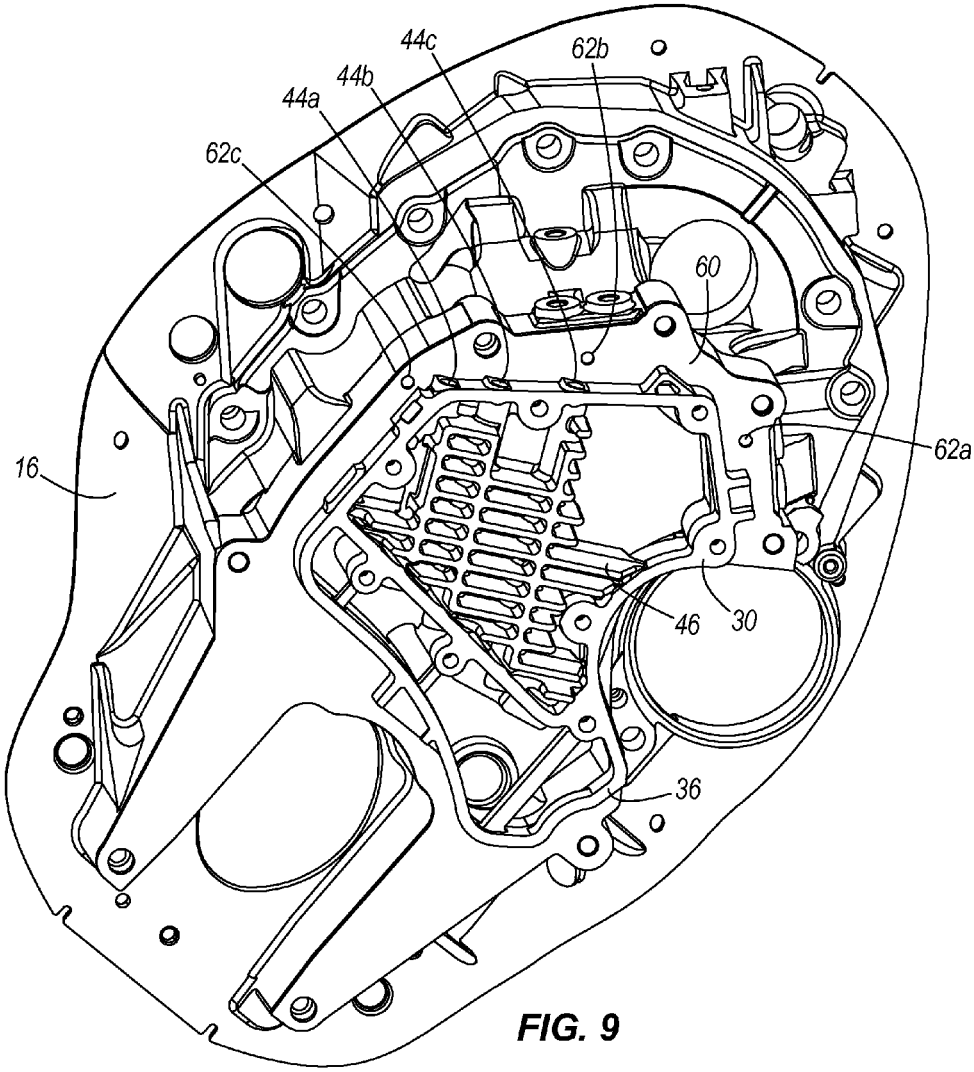
FIG. 9 is a view looking up at the heat exchanger attached to the bottom of the adapter plate.

FIG. 9 depicts the heat exchanger 30 connected to the bottom of the adapter plate 16. A gasket 60 is disposed between the adapter plate 16 and the heat exchanger 30 and includes throughholes 62*a*, 62*b*, 62*c* for distributing cooling water flowing from the channels 54, 56 to the cooling jacket 58. The heat exchanger 30 thus has top and bottom surfaces that abut the gasket 60 and sump 26, respectively.

Figure 10:
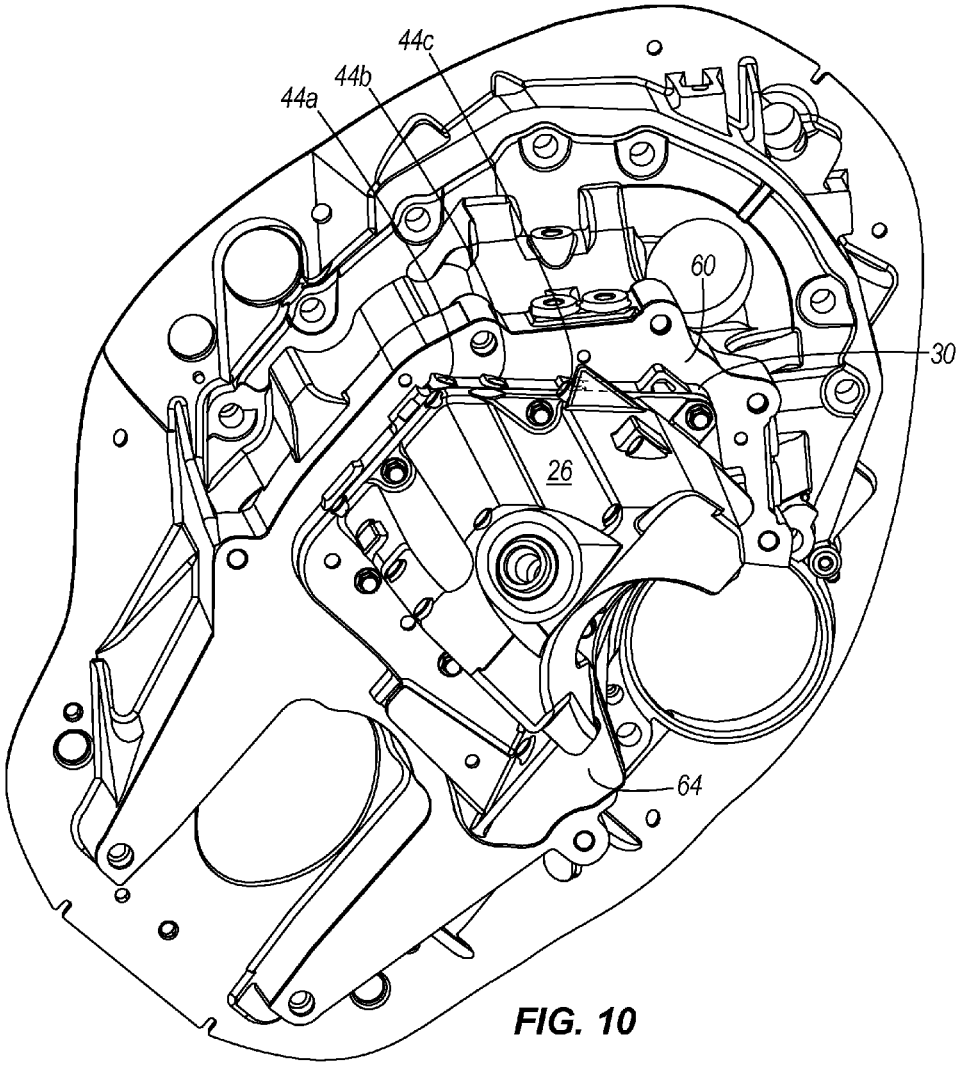
FIG. 10 is a view looking up at the oil sump attached to the heat exchanger and the bottom of the adapter plate.

FIG. 10 depicts the sump 26 connected to the bottom of the adapter plate 16 with the heat exchanger 30 and gasket 60 sandwiched therebetween. The sump 26 provides a floor at 64 for the plenum 38 on the heat exchanger 30. A housing (not shown) surrounds the sump 26 to define cooling jacket 58 for receiving cooling water from the adapter plate 16 and from the heat exchanger 30.

Figure 11:
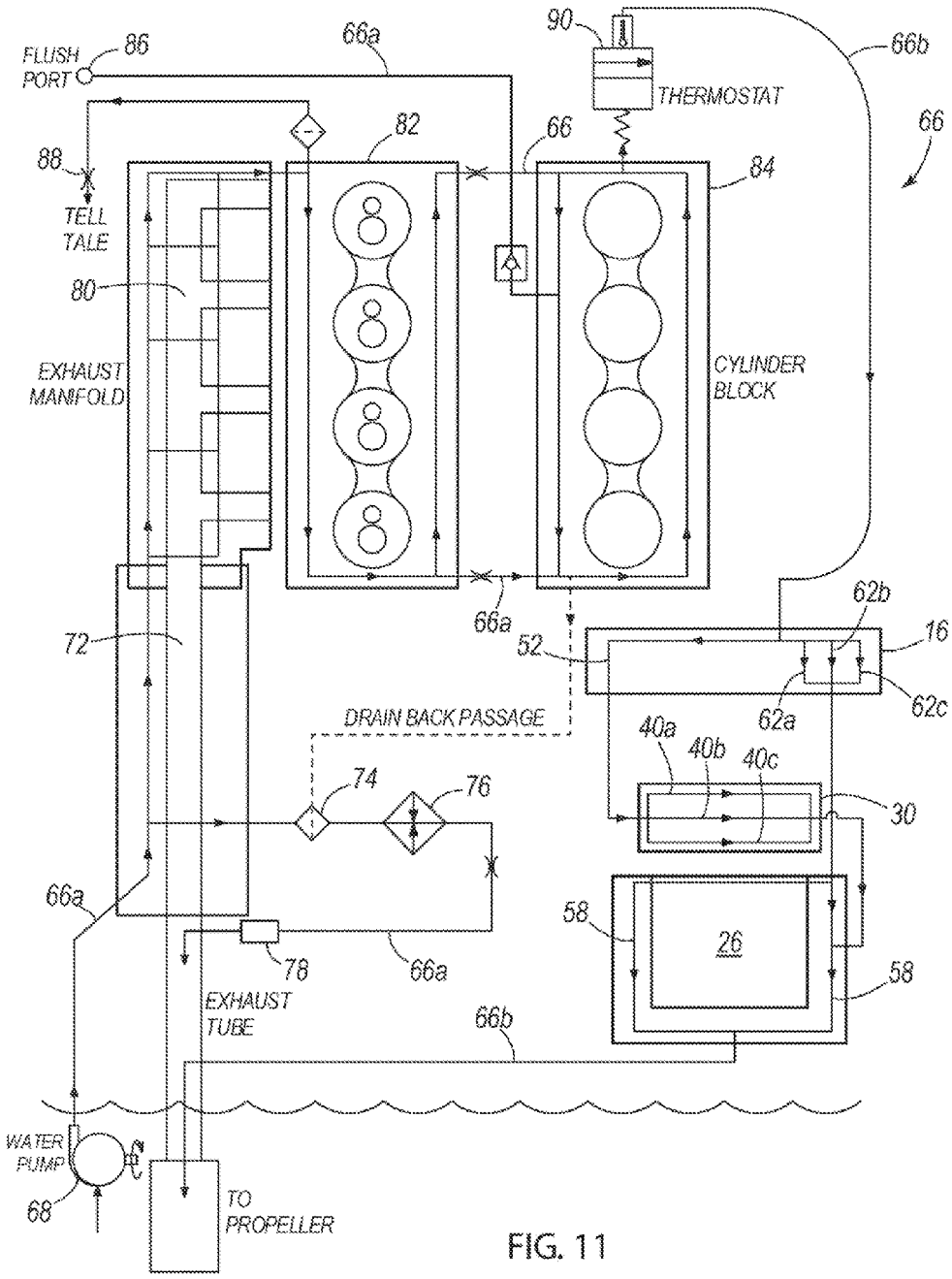
FIG. 11 is a schematic of a cooling circuit for the outboard motor.

FIG. 11 depicts a cooling circuit 66 for carrying cooling fluid that cools the internal combustion engine 12. A pump 68 located in the gear housing 20 (FIG. 1) draws water through the intake 34 in the gear housing 20 and pumps cooling water into the first portion of cooling circuit 66*a* in marine propulsion system 10. In this example, the cooling water is routed adjacent to an exhaust tube 72 cooling hot exhaust being discharged from the internal combustion engine 12. This feature is described in the incorporated U.S. patent application Ser. No. 12/944,454. A portion of the cooling water flows through a strainer 74 and fuel module 76 and discharged through an evaporative sprayer 78 for cooling hot exhaust. The remainder of the cooling water is conveyed adjacent to the exhaust tube 72 to cool the exhaust and thereafter to an exhaust manifold 80, cylinder head 82 and cylinder block 84. A flush port 86 is provided for flushing the cooling circuit 66 when the internal combustion engine 12 is not operating. A tell tale 88 is provided for discharging cooling fluid and providing a visual indicator of the status of the cooling circuit 66.

A thermostat 90 controls discharge of cooling fluid in the second portion of cooling circuit 66*b* to the heat exchanger 30 and the cooling jacket 58. The thermostat 90 discharges cooling fluid from the first portion of cooling circuit 66*a* based upon a temperature characteristic of the system 10. In one example, the thermostat 90 closes to reduce flow of cooling fluid in the second portion of cooling circuit 66*b* and opens to discharge cooling fluid to the heat exchanger 30 and the cooling jacket 58. The thermostat 90 can be configured to open and close based upon a temperature characteristic of at least one of the cooling fluid and the oil in the internal combustion engine 12, according to conventional arrangements.

Cooling fluid that is discharged from the thermostat 90 flows through the adapter plate 16 via passageways 54, 56 and holes 62*a*, 62*b*, 62*c* directly to the cooling jacket 58 adjacent to the sump 26, or alternately through the passageway 52 to the heat exchanger 30 via passages 40*a*, 40*b*, 40*c* before discharge to the cooling jacket 58. Cooling water from the cooling jacket 58 can be discharged back to the body of water via for example the gear housing 20.

What is claimed is:

1. A marine propulsion system comprising:

an internal combustion engine;

a cooling circuit carrying cooling fluid that cools the internal combustion engine;

a sump holding oil that drains from the internal combustion engine;

a heat exchanger receiving the colling fluid;

wherein the oil that drains from the internal combustion engine to the sump passes through and is cooled by the heat exchanger;

wherein the heat exchanger comprises a plurality of passages carrying the cooling fluid; and a cooling jacket adjacent the sump, the cooling jacket receiving the cooling fluid directly from the heat exchanger and cooling the sump.

2. A marine propulsion system, the marine propulsion system comprising:

an internal combustion engine;

a sump holding oil that drains by gravity from the internal combustion engine;

a heat exchanger that is disposed at least partially between the internal combustion engine and the sump;

wherein as the oil drains by gravity from the internal combustion engine to the sump, the oil passes through the heat exchanger;

a cooling circuit comprising an upstream first portion that receives cooling water from a body of water in which the marine propulsion system is operating, wherein the first portion circulates cooling water through the internal combustion engine;

the cooling circuit further comprising a downstream second portion that discharges the cooling water from the first portion back to the body of water in which the marine propulsion system is operating, wherein the second portion conveys the cooling water through the heat exchanger to thereby cool the heat exchanger;

a thermostat that separates the first portion of the cooling circuit from the second portion of the cooling circuit, wherein the thermostat controls discharge of the cooling water from the first portion of the cooling circuit to the second portion of the cooling circuit based upon a temperature characteristic of the marine propulsion system.

3. The marine propulsion system according to claim 1, comprising a pump that draws the cooling water from a body of water in which the marine propulsion system is operating.

4. The marine propulsion system according to claim 3, wherein the first portion of the cooling circuit routes the cooling water adjacent to exhaust tube for the internal combustion engine, thereby cooling hot exhaust being discharged from the internal combustion engine prior to circulating the cooling water through the internal combustion engine.

5. The marine propulsion system according to claim 4, wherein the first portion of the cooling circuit further routes the cooling water adjacent to an exhaust manifold, cylinder head and cylinder block of the internal combustion engine.

6. The marine propulsion system according to claim 1, wherein the thermostat closes to reduce flow of the cooling water in the second portion of the cooling circuit and opens to discharge the cooling water from the first portion of the cooling circuit to the second portion of the cooling circuit.

7. The marine propulsion system according, to claim 2, wherein the temperature characteristic is a temperature of the cooling water.

8. The marine propulsion system according to claim 2, wherein the temperature characteristic is a temperature of the oil in the internal combustion engine.

9. The marine propulsion system according to claim 8, wherein the temperature characteristic comprises both a temperature of the cooling water and as temperature of the oil in the internal combustion engine.

10. The marine propulsion system according, to claim 2, wherein cooling water that is discharged to the second portion of the cooling circuit by the thermostat flows through the heat exchanger and into a cooling jacket for the oil sump.

11. The marine propulsion system according to claim 10, wherein the cooling water in the second portion of the cooling jacket is discharged to the body of water in which the marine propulsion system is operating.

12. An outboard motor comprising:

an internal combustion engine;

a sump holding oil that drains by gravity from the internal, combustion engine;

a heat exchanger that is disposed at least partially between the internal combustion engine and the sump such that as the oil drains by gravity from the internal combustion engine to the sump, the oil passes through the heat exchanger;

wherein the heat exchanger comprises a plurality of cooling passages that are spaced apart and transversely oriented to the oil that drains from the internal combustion engine to the sump so that the oil passes between the passages as the oil drains to the sump; and a cooling circuit providing cooling fluid from the internal combustion engine to the plurality of cooling passages.

13. The outboard motor according to claim 12, wherein the heat exchanger comprises a frame that is transversely oriented to the oil that drains from the internal combustion engine, wherein the plurality of cooling passages are formed in the frame.

14. The outboard motor according to claim 13, wherein a plenum is formed in the frame, the plenum collecting the cooling fluid expelled from the internal combustion engine and distributing the cooling fluid to the plurality of passages.

15. The outboard motor according to claim 13, comprising a plurality of fins that are formed on the plate, wherein the fins are cooled by cooling fluid flowing through the plurality of passages.

16. The outboard motor according to claim 15, wherein the plurality of fins is vertically oriented such that oil draining from the internal combustion engine to the sump vertically flows along the plurality of fins.

17. The outboard motor according to claim 13, comprising an adapter plate supporting the internal combustion engine, wherein the heat exchanger is disposed between the adapter plate and the sump.

18. The outboard motor according to claim 17, wherein the adapter plate defines an opening though which the oil drains from the internal combustion engine to the sump, and wherein the frame is coupled to the adapter plate such that the frame covers the opening.

19. The outboard motor according to claim 18, wherein the adapter plate defines channels through which cooling fluid bypasses the frame and is conveyed to a cooling jacket along an outside surface of the sump.

20. The outboard motor according to claim 12, comprising a cooling jacket on the sump, the cooling jacket receiving cooling fluid from the heat exchanger and cooling the sump.

21. An outboard motor comprising:

an internal combustion engine;

a sump holding oil that drains from the internal combustion engine;

a heat exchanger that is disposed at least partially between the internal combustion engine and the sump such that as the oil drains by gravity from the internal combustion engine to the sump, the oil passes through the heat exchanger;

wherein the heat exchanger comprises a plurality of cooling passages that are spaced apart and transversely oriented to the oil that drains from the internal combustion engine to the sump so that the oil passes between the passages as the oil drains to the sump;

a cooling circuit comprising an upstream first portion that receives cooling water from a body of water in which the marine propulsion system is operating, wherein the first portion circulates cooling water through the internal combustion engine;

the cooling circuit comprising a downstream second portion that discharges the cooling water from the first portion back to the body of water in which the marine propulsion system is operating, wherein the second portion conveys the cooling water to the heat exchanger to thereby cool the heat exchanger; and an adapter plate supporting the internal combustion engine, wherein the heat exchanger is disposed between the adapter plate and the sump; wherein the adapter plate defines an opening, though which the oil drains from the internal combustion engine to the sump; and wherein the frame is coupled to the adapter plate such that the frame covers the opening.

* * * * *